US006499467B1

(12) United States Patent
Morris et al.

(10) Patent No.: US 6,499,467 B1
(45) Date of Patent: Dec. 31, 2002

(54) CLOSED NOZZLE FUEL INJECTOR WITH IMPROVED CONTROLLABILTY

(75) Inventors: C. Edward Morris, Columbus, IN (US); Bjorn Westman, Ekero (SE); Mark S. Cavanagh, Bloomington, IL (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 09/541,669

(22) Filed: Mar. 31, 2000

(51) Int. Cl.[7] ..... F02M 37/04
(52) U.S. Cl. ..... 123/467; 123/446; 239/533.3
(58) Field of Search ..... 123/467, 446, 123/496; 239/533.1, 533.3, 533.2

(56) References Cited

U.S. PATENT DOCUMENTS

| | | | | | |
|---|---|---|---|---|---|
| 2,959,360 | A | | 11/1960 | Nichols | |
| 4,249,497 | A | | 2/1981 | Eheim et al. | |
| 4,427,152 | A | | 1/1984 | Sisson et al. | |
| 4,545,352 | A | | 10/1985 | Jourde et al. | |
| 4,627,571 | A | | 12/1986 | Kato et al. | |
| 4,684,067 | A | | 8/1987 | Cotter et al. | |
| 4,798,186 | A | | 1/1989 | Ganser | |
| 5,012,786 | A | | 5/1991 | Voss | |
| 5,133,645 | A | | 7/1992 | Crowley et al. | |
| 5,176,120 | A | | 1/1993 | Takahashi | |
| 5,463,996 | A | | 11/1995 | Maley et al. | |
| 5,535,723 | A | | 7/1996 | Gibson et al. | |
| 5,551,398 | A | | 9/1996 | Gibson et al. | |
| 5,638,791 | A | | 6/1997 | Tsuzuki et al. | |
| 5,671,715 | A | | 9/1997 | Tsuzuki | |
| 5,676,114 | A | | 10/1997 | Tarr et al. | |
| 5,682,858 | A | * | 11/1997 | Chen et al. | 123/467 |
| 5,694,903 | A | | 12/1997 | Ganser | |
| 5,709,194 | A | * | 1/1998 | Moncelle | 123/446 |
| 5,711,277 | A | * | 1/1998 | Fuseya | 123/496 |
| 5,732,679 | A | * | 3/1998 | Takahasi et al. | 123/467 |
| 5,771,865 | A | | 6/1998 | Ishida | |
| 5,820,033 | A | | 10/1998 | Cooke | |
| 5,860,597 | A | | 1/1999 | Tarr | |
| 5,873,526 | A | | 2/1999 | Cooke | |
| 5,899,389 | A | * | 5/1999 | Pataki et al. | 239/533.2 |
| 5,941,215 | A | | 8/1999 | Augustin | |
| 6,053,432 | A | * | 4/2000 | Stevens | 239/533.2 |
| 6,189,817 | B1 | * | 2/2001 | Lambert | 239/533.3 |
| 6,196,472 | B1 | | 3/2001 | Cooke | |

* cited by examiner

*Primary Examiner*—Carl S. Miller
(74) *Attorney, Agent, or Firm*—Nixon Peabody LLP; Charles M. Leedom, Jr.; Tim L. Brackett, Jr.

(57) ABSTRACT

A novel and improved closed nozzle injector is provided which effectively and accurately controls the timing and rate of fuel injection while minimizing parasitic losses and needle valve element wear. The closed nozzle injector includes a needle valve element movable between open and closed positions, an outer control volume, an injection control valve for controlling the flow of pressurized fuel from the outer control volume to affect opening and closing of the needle valve element and a needle valve biasing feature for optimizing the speed of needle valve opening and closing. The needle valve biasing feature includes an inner guide portion formed on the needle valve element with a larger diameter than an outer guide portion, an inner control volume, and an inner restriction orifice for restricting the flow of pressurized supply fuel to the inner control volume to create a fuel pressure bias closing force which advantageously slows down the opening of the needle valve element. The fuel pressure bias closing force increases as the needle valve element opens thereby causing the needle valve element to hover in an open position without contacting a hard stop. The inner control volume and inner restriction orifice also result in a hydraulic damper effect which slows the closing motion of the needle valve element toward the end of the closing event thereby permitting higher needle closing velocity earlier in the closing event.

17 Claims, 3 Drawing Sheets

CLOSED NOZZLE FUEL INJECTOR WITH IMPROVED CONTROLLABILTY

TECHNICAL FIELD

This invention relates to closed nozzle fuel injectors having a control chamber for permitting servo-control of a needle valve element and, specifically, to a servo-controlled closed nozzle injector which effectively control needle valve movement to enhance injector operation and combustion in an engine.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection. In another type of system, such as disclosed in U.S. Pat. No. 5,676,114 to Tarr et al., the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event and decreasing the time required for valve closing. It is also desirable to limit the impact velocity of the needle valve element against its seat upon closing. As a result, many proposals have been made to provide control devices in closed nozzle fuel injector systems. U.S. Pat. No. 5,133,645 to Crowley et al. discloses a common rail fuel injection system having two common rails serving respective banks of injectors. Fuel is supplied to each rail by a respective cam-operated reciprocating plunger pump. Each injector includes a nozzle element positioned in a spring cavity which receives high pressure fuel from the common rail via a check valve. The spring cavity is also connected, via an orifice, to a pressure control volume positioned above the nozzle element. A solenoid operated control valve opens to connect the control volume to drain thereby initiating injection as fuel flows from the nozzle cavity through the orifice to drain, and closes to terminate injection. U.S. Pat. No. 4,249,497 to Eheim et al. discloses a fuel injection system wherein fuel injection is controlled by controlling the differential pressure across a nozzle valve element using a single valve which opens to direct fuel to drain so as to start injection and closes to end injection. However, these references fail to disclose a means for effectively controlling the rate of needle valve element opening and closing.

U.S. Pat. No. 5,638,791 to Tsuzuki et al. and U.S. Pat. No. 5,771,865 to Ishida both disclose a common-rail fuel injection system with a fuel injector having a back pressure control chamber (pressure chamber) which is fluidically connected to a high-pressure inlet port (fuel pipe) and a control port (low pressure passage) which drains to a solenoid actuator. These references also disclose orifices that restrict the flow of fluid into the back pressure control chamber and the solenoid actuator passage.

U.S. Pat. No. 5,941,215 to Augustin is noted for disclosing a fuel injector having a spring chamber which is fluidically connected to a supply line via a passage which acts as a simple throttle structure.

U.S. Pat. No. 2,959,360 to Nichols discloses a fuel injector nozzle assembly incorporating passages in the nozzle assembly for diverting the fuel from the nozzle assembly. Specifically, Nichols discloses a nozzle valve element having an axial passage formed therein for diverting fuel from the nozzle cavity into an expansible chamber formed in the nozzle valve element. A plunger is positioned in the chamber to form a differential surface creating a fuel pressure induced seating force on the nozzle valve element to aid in rapidly seating the valve element. The Nichols reference does not suggest the desirability of controlling the rate of opening and closing of the nozzle valve element.

Although some systems discussed hereinabove control needle valve element movement, further improvement is desirable. None of the above discussed references disclose a fuel injector incorporating a simple servo-controlled needle valve capable of increasing the time required to open the needle valve element and decreasing the time required for valve closing while limiting the impact velocity of the needle valve element against its seat upon closing.

SUMMARY OF THE INVENTION

It is an object of the present invention, therefore, to overcome the disadvantages of the prior art and to provide a fuel injector which is capable of effectively and predictably controlling the opening and closing of a needle valve element to permit control of the rate of fuel injection.

It is another object of the present invention to provide a servo-controlled injector capable of effectively slowing the opening of the needle valve element.

Yet another object of the present invention is to provide a servo-controlled injector capable of effectively speeding up the closing of the needle valve element.

It is another object of the present invention to provide a servo-controlled injector capable preventing the needle valve element from sticking in the open position.

It is yet another object of the present invention to provide a servo-controlled injector permitting the flow rate of fuel injected during the initial portion of the injection event to be more accurately controlled so as to minimize emissions.

It is a further object of the present invention to provide an injector for use in a variety of fuel systems, including common rail system, accumulator pump systems and pump-line-nozzle fuel systems, which effectively controls the rate of injection.

It is a still further object of the present invention to provide a servo-controlled injector capable of preventing needle valve element bounce in the open position.

Still another object of the present invention is to provide a servo-controlled injector wherein the needle valve element can hover on a fuel cushion when in the open position.

Yet another object of the present invention is to provide an injector which offers maximum flexibility in controlling injection rate shape.

Still another object of the present invention is to provide a servo-controlled injector which provides a quick needle valve element closing while limiting the impact velocity of the needle valve element against its seat.

It is a still further object of the present invention to provide a servo-controlled injector capable of minimizing parasitic fuel losses.

These and other objects of the present invention are achieved by providing a closed nozzle injector for injecting fuel at high pressure into the combustion chamber of an engine, comprising an injector body containing an injector cavity and an injector orifice communicating with one end of the injector cavity to discharge fuel into the combustion chamber wherein the injector body includes a fuel transfer circuit for transferring supply fuel to the injector orifice. The injector also includes a nozzle valve element positioned in one end of the injector cavity adjacent the injector orifice and movable between an open position in which fuel may flow from the fuel transfer circuit through the injector orifice into the combustion chamber and a closed position in which fuel flow through the injector orifice is blocked. Movement of the nozzle valve element from the closed position to the open position and from the open position to the closed position defines an injection event during which fuel may flow through the injector orifice into the combustion chamber. The needle valve element includes an inner guide portion having an outer surface contacting the injector body and an outer guide portion having an outer surface contacting the injector body. The inner guide outer surface includes an outer diameter greater than an outer diameter of the outer guide outer surface. The closed nozzle injector further includes an outer control volume positioned adjacent an outer end of the needle valve element, a control volume charge circuit for supplying fuel from the fuel transfer circuit to the outer control volume, a drain circuit for draining fuel from the outer control volume to a low pressure drain, an injection control valve positioned along the drain circuit for controlling the flow of fuel through the drain circuit to control the movement of the needle valve element between the open and closed positions and an inner control volume positioned axially along the needle valve element between the inner guide portion and the injector orifice.

The closed nozzle injector may include a spring chamber positioned axially along the needle valve element between the inner guide portion and the outer guide portion and a bias spring positioned in the spring chamber to bias the needle valve element toward the closed position. The spring chamber is positioned to receive unrestricted high pressure fuel from the fuel pressure circuit. The fuel injector may further include an inner restriction orifice positioned to restrict fuel flow from the fuel transfer circuit to the inner control volume wherein the inner restriction orifice is sized to create a pressure difference between the fuel transfer circuit and the inner control volume. The fuel injector may further include an outer restriction orifice positioned to restrict fuel flow from the fuel transfer circuit to the outer control volume. The outer diameter of the inner guide outer surface is sized to generate a fuel pressure biasing force acting on the inner guide portion which tends to bias the needle valve element toward the closed position during an injection event. The needle valve element may be a one-piece unitary structure including the inner and the outer guide portions. The needle valve element may further include a valve seat portion have a valve seat diameter less than the outer guide portion diameter. The inner restriction orifice may be formed in the needle valve element.

The present invention is also directed to a closed nozzle injector for injecting fuel at a high pressure into the combustion chamber of an engine comprising the injector body, the nozzle valve element movable between open and closed positions, the outer control volume, the control volume charge circuit, the drain circuit, the injection control valve and a needle valve biasing feature for creating a fuel pressure bias closing force on the needle valve element which biases the needle valve element toward the closed position and for increasing the fuel pressure bias closing force on the needle valve element during movement from the closed position to the open position. The needle valve biasing feature further functions for creating a fuel pressure bias opening force on the needle valve element which biases the needle valve element toward the open position and for increasing the fuel pressure bias opening force as the needle valve element moves from the open position toward the closed position. The needle valve biasing feature may further include the inner guide and outer guide portions, the inner control volume, the inner restriction orifice, the outer restriction orifice and/or the valve seat portion having a valve seat diameter less than the outer guide portion diameter.

DETAILED DESCRIPTION OF THE PREFERRED EMBODIMENT

Throughout this application, the words "inward", "innermost", "outward" and "outermost" will correspond to the directions, respectively, toward and away from the point at which fuel from an injector is actually injected into the combustion chamber of an engine. The words "upper" and "lower" will refer to the portions of the injector assembly which are, respectively, farthest away and closest to the engine cylinder when the injector is operatively mounted on the engine.

Figure 1:
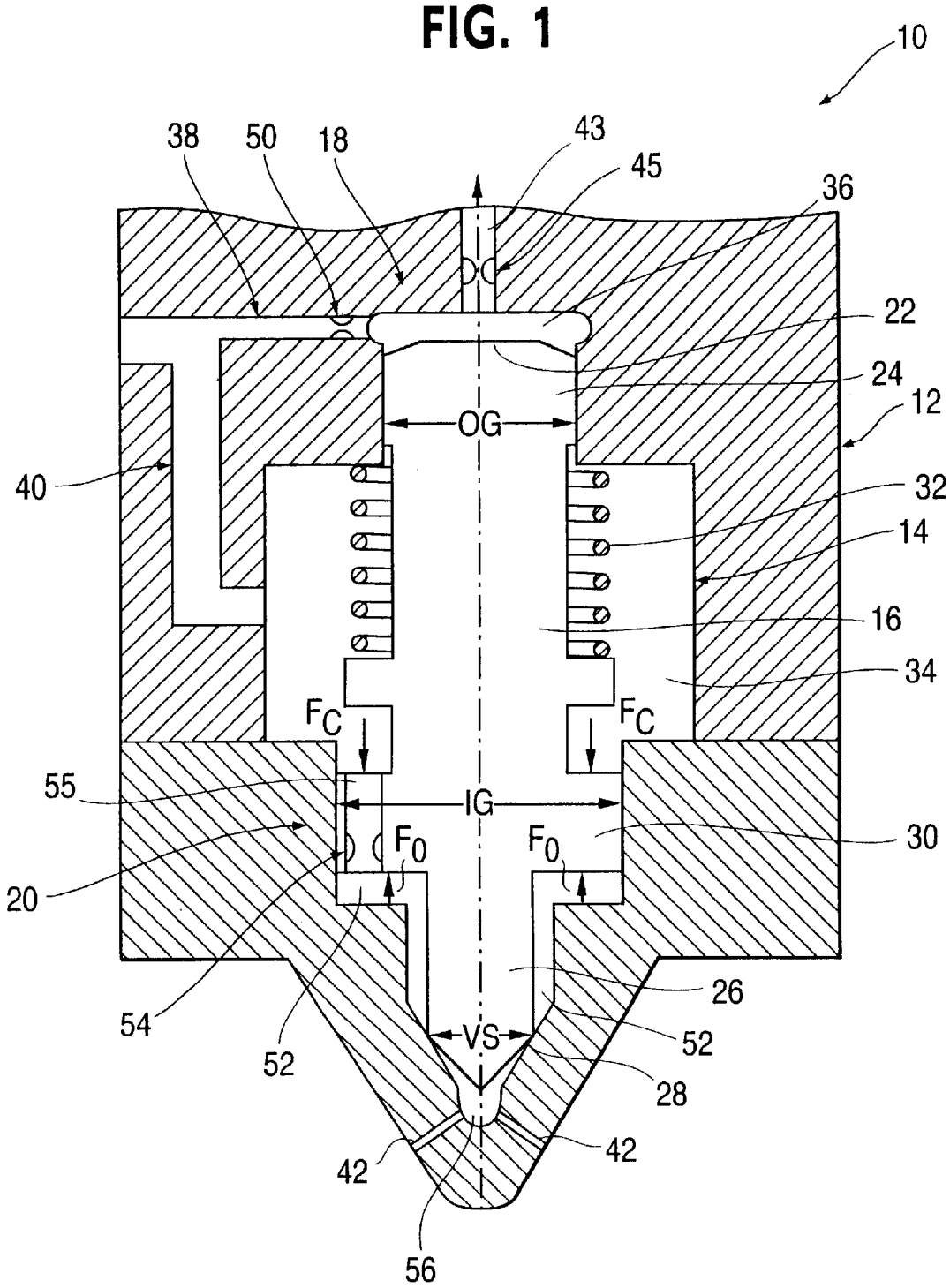
FIG. 1 is a cross-sectional schematic illustration of the closed nozzle assembly used in the injector of the present invention.

Referring to FIG. 1, there is shown a schematic illustration of the closed nozzle portion of the closed nozzle injector 10 of the present invention, indicated generally at 10, for more effectively controlling fuel injection thereby reducing emissions. Closed nozzle injector 10 generally includes an injector body 12 containing an injector cavity 14, a needle valve element 16 mounted for reciprocal movement in injector cavity 14, a needle valve actuating system 18 and a needle valve biasing feature 20 for enhancing the opening and closing rates of needle valve element 16 thereby enabling more accurate control of fuel injection.

Figure 2A:
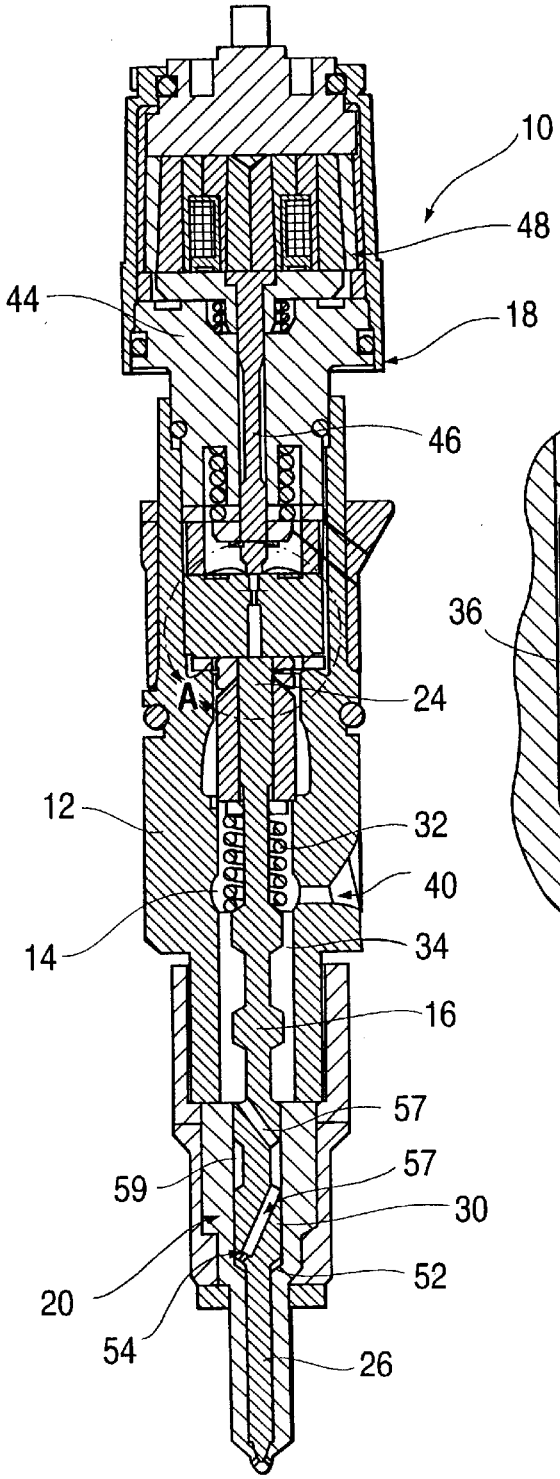
FIG. 2*a* is a cross-sectional view of a closed nozzle injector of the present invention.
Figure 2B:
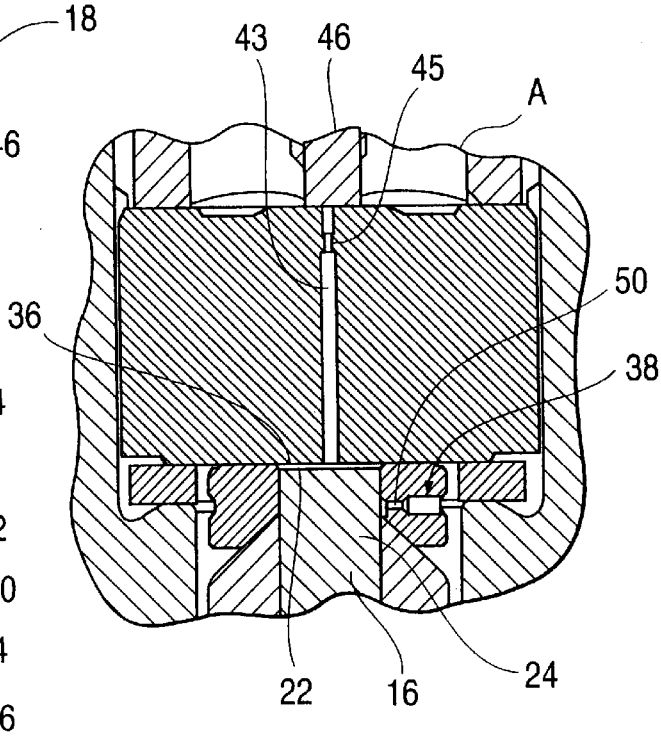
FIG. 2*b* is an expanded view of the area A of FIG. 2*a;*

Although the present discussion of closed nozzle injector 10 of the present invention will be made with reference to FIG. 1, a practical embodiment of closed nozzle injector 10 is shown in FIGS. 2*a* and 2*b* wherein like reference numerals are used to indicate the same or similar components and features. Therefore, during the following discussion, reference may be made to FIGS. 2*a* and 2*b*. However, FIG. 1 will now be discussed to illustrate and explain a perhaps more understandable simplified schematic of the present closed nozzle injector 10. Needle valve element 16 includes an outer end 22 including an outer guide portion 24 having an outer peripheral extent sized and positioned to form a close sliding fit with the inside surface of injector cavity 14 thereby creating a fluid seal which substantially prevents fluid from leaking from the clearance between outer guide portion 24 and the opposing surface of injector body 12 forming injector cavity 14. Needle valve element 16 also includes a valve seat portion 26 positioned at an inner end for sealingly engaging a valve seat 28 formed on injector body 12 when needle valve element 16 is in the closed position as shown in FIG. 1. Needle valve element 16 also includes an inner guide portion 30 formed adjacent valve seat portion 26 and sized to form a close sliding fit with the inside surface of fuel injector cavity 14 creating a fluid seal which substantially prevents fluid from leaking from the clearance between the outer surface of inner guide portion 30 and the opposing surface of injector body 12 forming injector cavity 14.

Needle valve element 16 is biased into the closed position by a bias spring 32 positioned in a spring chamber 34 formed between outer guide portion 24 and inner guide portion 30. Needle valve actuating system 18 includes an outer control volume or cavity 36 formed in injector body 12 and positioned adjacent outer end 22 of needle valve element 16. Needle valve actuating system 18 also includes a control volume charge circuit 38 for directing supply fuel from a fuel transfer circuit 40 to outer control volume 36. Fuel transfer circuit 40 also delivers supply fuel to spring chamber 34 for delivery to injector orifices 42 when needle valve element 16 is in an open position as discussed more fully hereinbelow. Needle valve actuating system 18 also includes a drain circuit 43 for draining fuel from outer control volume 36 and an injection control valve 44 (FIG. 2*a*) positioned along drain circuit 43 for controlling the flow of fuel through drain circuit 43 so as to cause controlled movement of needle valve element 16 between open and closed positions. As shown in FIGS. 1 and 2*a*, control volume charge circuit 38 is in continuous fluid communication with outer control volume 36.

As shown in FIG. 2*a*, injection control valve 44 includes a control valve member 46 and an actuator assembly 48 for selectively moving control valve member 46 between an open position permitting flow through drain circuit 43 and a closed, seated position, as shown in FIG. 2*b*, blocking flow through drain circuit 43. It should be noted that actuator assembly 48 may be any type of actuator assembly capable of selectively and quickly controlling the movement of control valve member 46. For example, actuator assembly may be of the electromagnetic, magnetostrictive or piezoelectric type.

Control volume charge circuit 38 includes an outer restriction orifice 50 designed with a smaller cross sectional flow area than drain circuit 43. Upon actuation of actuator assembly 48 and movement of control valve member 46 from the closed position as shown FIG. 2*b* to an open position, high pressure fuel in outer control volume 36 is permitted to flow from outer control volume 36 through drain circuit 43. Simultaneously, high pressure supply fuel flows through control volume charge circuit 38 and outer restriction orifice 50 into outer control volume 36. However, outer restriction orifice 50 is designed with a smaller cross sectional flow area than a restriction 45 positioned in drain circuit 43 and thus a greater amount of fuel is drained from outer control volume 36 than is replenished via control volume charge circuit 38. As a result, the pressure in outer control volume 36 immediately decreases resulting in the movement of needle valve element 16 from the closed position toward the open position.

Needle valve biasing feature 20 includes inner guide portion 30 and outer guide portion 24 and, more specifically, the relative sizing of inner and outer guide portions 30, 24 to achieve desirable fuel pressure biasing forces on needle valve element 16 during an injection event. In addition, needle valve biasing feature 20 includes an inner control volume 52 formed axially between inner guide portion 30 and injector orifice 42. Inner control volume 52 surrounds valve seat portion 26 and contains fuel for injection into an engine combustion chamber upon opening of needle valve element 16. Needle valve biasing feature 20 further includes an inner restriction orifice 54 formed in needle valve element 16. In the schematic of FIG. 1, inner restriction orifice 54 is formed in a transfer passage 55 extending through inner guide portion 30 of needle valve element 16. In the more practical embodiment of FIG. 2*a*, the transfer passage is in the form of two transverse passages 57 connected by an annular groove 59. However, the transfer passages and inner restriction orifice 54 may alternatively be formed in the injector/nozzle housing.

Inner restriction orifice 54 restricts the flow of fuel from spring chamber 34 into inner control volume 52 upon opening of needle valve element 16 to create a desired force profile on needle valve element 16. Specifically, inner restriction orifice 54, the relative sizing between outer guide portion 24 and inner guide portion 30, and use of inner control volume 52 function to enhance the resulting force on needle valve element 16 during the injection event by creating fuel pressure biasing forces in the following manner. In general, by creating a significantly larger needle valve element cross sectional area at inner guide portion 30 relative to outer guide portion 24, and by restricting the flow path from spring chamber 34 to inner control volume 52, a small pressure drop across inner restriction orifice 54 is achieved thereby creating a higher pressure in spring chamber 34 than inner control volume 52. As a result, the desired closing force $F_c$ acts on needle valve element 16 thereby slowing down the opening of needle valve element 16. The larger lower guide diameter makes it possible to generate a significant downward force $F_c$ on needle valve element 16 using the small pressure drop between spring chamber 34 and inner control volume 52 created by inner restriction orifice 54, for all conditions where the needle is lifted from its valve seat 28. The downward force $F_c$ also speeds up the closing of the needle valve element 16 which enhances fuel injection control and accuracy thereby improving emissions.

Upon actuation of actuator assembly 48 and opening of control valve member 46, the pressure in outer control volume 36 decreases, causing needle valve element 16 to lift from its valve seat 28. When needle valve element 16 begins to lift, fuel pressure increases in the sac 56 thereby assisting in lifting the needle at an even greater rate. Simultaneously, fuel begins to flow from sac 56 through injector orifices 42 into the engine combustion chamber (not shown). As pressurized fuel flows from sac 56 and inner control volume 52 through injector orifices 42, a corresponding flow is created from spring chamber 34 through inner restriction orifice 54 into inner control volume 52 thereby creating a pressure drop between spring chamber 34 and inner control volume 52. The flow and the pressure drop across inner restriction orifice 54 is increased by the volume of fuel displaced from spring chamber 34 to inner control volume 52 to allow the movement of the needle thereby creating a dynamic pressure drop which varies throughout the movement of needle valve element 16. It's important to note that a stiffer/smaller inner control volume 52 enhances the pressure drop thereby causing a more rapid build-up of a "static pressure drop". While the pressure drop across valve seat 28 varies as a function of needle position, the maximum injection orifice flow, and thereby the "static" pressure drop across inner restriction orifice 54, only reaches its full level when needle valve element 16 is close to its open position. This ramped increase in the magnitude of the pressure drop and thus the magnitude of force $F_c$, creates a desired force profile on the needle valve element 16 wherein the downward force $F_c$ is building up as the lift and speed of the needle valve element 16 increases.

When in its fully open position, needle valve element 16 will float on a fuel cushion generated in outer control volume 36 between outer end 22 of needle valve element 16 and the opposing wall forming outer control volume 36. That is, when the end face of outer end 22 of needle valve element 16 begins to obstruct the flow path into drain circuit 43, fuel between the end face and the opposing wall is compressed and increased in pressure causing needle valve element 16 to "hover" in a stable condition very close to the opposing wall of outer control volume 36. Importantly, needle valve biasing feature 20 achieves this desirable "hover" condition by generating a fuel pressure bias closing force $F_c$ of a significant magnitude using the large effective area of inner guide portion 30 and the pressure drop created by inner restriction orifice 54 such that the closing force $F_c$ increases as needle valve element 16 moves into the open position. As a result, this feature limits the fuel flow through drain circuit 43 thereby minimizing parasitic losses while minimizing the controllability issues experienced in conventional needle designs that contact and bounce against a hard stop when moving into the open position.

Upon de-energization of actuator assembly 48 and movement of control valve member 46 into a closed position as shown in FIG. 2*b*, fuel pressure begins to build in outer control volume 36 resulting in a downward movement of needle valve element 16 toward its closed position. The displacement or movement of needle valve element 16 toward inner control volume 52 causes a decrease in the volume of inner control volume 52 resulting in a lowering of the pressure drop through inner restriction orifice 54. Consequently, the present invention creates a hydraulic damper due to the captured fuel in inner control volume 52 which generates a dynamic upward force $F_o$ tending to open needle valve element 16. The closer needle valve element 16 gets to its valve seat 28, the greater the pressure drop across valve seat 28 resulting in a lowering of the "static" flow through inner restriction orifice 54. This effect will also lower the fuel pressure bias closing force $F_c$ generated on inner guide portion 30 by the present invention. The fuel pressure bias opening force $F_o$ also compensates for the increasing total downward/closing force on the needle generated by the decreasing fuel pressure in sac 56. As a result, needle valve biasing feature 20 of the present invention enables a significantly higher needle closing velocity while providing a hydraulic damper near the end of the closing event to prevent violation of seat impact velocity constraints.

The closed nozzle injector of the present invention incorporating needle valve biasing feature 20 benefits from minimizing the volume of outer control volume 36 and inner control volume 52. The allowable pressure drop between spring chamber 34 and inner control volume 52 during injection, sets the lower limit for how small the inner control volume 52 can be. Preferably, a small pressure drop across inner restriction orifice 54 is utilized by maximizing the diameter of inner guide portion 30 within the injector size constraints. The valve seat portion diameter VS, the spring force of bias spring 32, the size of outer restriction orifice 50 and drain restriction orifice 45, and the diameter of outer guide portion 24, together with the shape of outer control volume 36, are optimized to provide the desired needle opening/closing speeds and hovering characteristics over the injector operating range. Importantly, the major benefit of the increased diameter and thus increased cross sectional area of inner guide portion 30 is the ability to maximize the desired dynamic and static forces without substantially restricting fuel flow through inner restriction orifice 54. As a result, the pressure drop through inner restriction orifice 54 during the injection event is minimized thereby permitting the sac injection pressure to advantageously be maintained as close to the supply pressure as possible thereby maintaining effective high pressure injection and atomization through injection orifices 42.

The closed nozzle injector of the present invention can be adapted for use with a variety of injectors and fuel systems. For example, closed nozzle injector 10 may receive high pressure fuel from a high pressure common rail or alternatively, a dedicated pump assembly, such as in a pump-line-nozzle system or a unit injector system incorporating, for example, a mechanically actuated plunger into the injector body. Due to the advantage of the present design in slowing the opening of the needle valve element and thus the injection rate during the initial portion of the injection event, the present closed nozzle injector may advantageously be used in combination with an additional rate control device, such as a rate shaping feature integrated or separate from the fuel injector, and/or a pilot fuel injection control design.

Figure 3A:
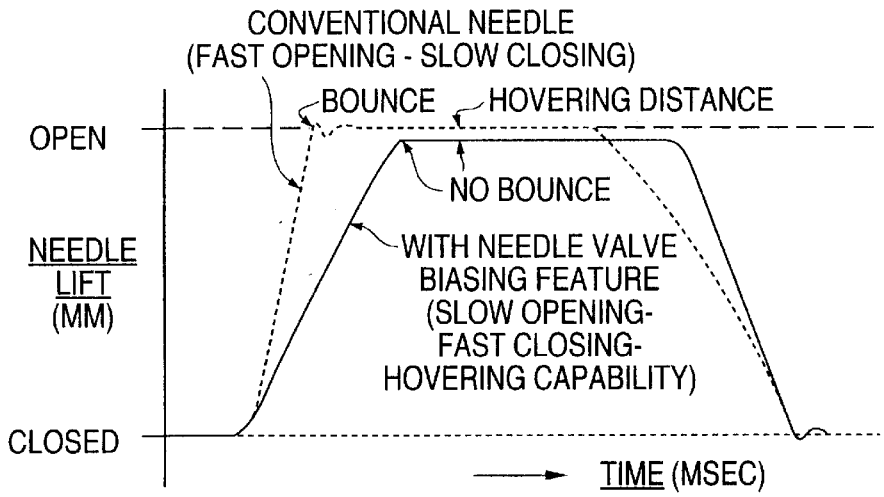
FIG. 3*a* is a graph showing a comparison between the needle lift versus time for a given injection event achieved using a conventional servo-controlled injector and the injector of the present invention.
Figure 3B:
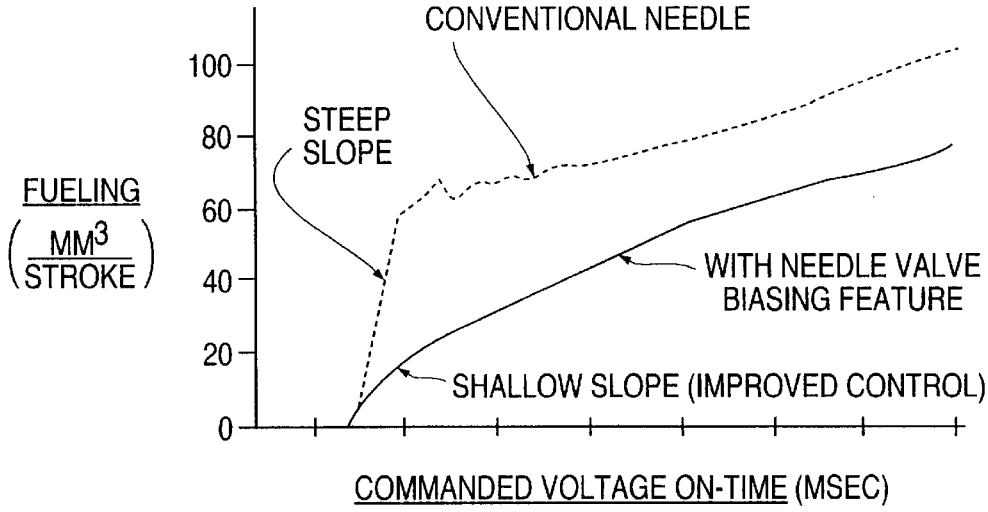
FIG. 3*b* is a graph showing a comparison between the fueling rate versus commanded voltage on-time for a given injection event achieved using a conventional servo-controlled injector and the injector of the present invention.

The closed nozzle injector of the present invention including the needle valve biasing feature 20 effectively achieves a variety of advantages over conventional servo controlled injectors. First, referring to FIGS. 3*a* and 3*b*, needle valve biasing feature 20 effectively slows down the opening and speeds up the closing of needle valve element 16 during an injection event. Conventional servo controlled injectors including only a single outer control volume inherently create a fast opening and a slow start of closing of the needle valve element. This fast opening/slow closing is due to the exposure of the needle tip area below the valve element seat to injection pressure when the needle valve element lifts during injection. Towards the end of a needle closing event, a pressure drop is developed over the needle seat and the lower pressure on the needle tip generates a downward force that tends to accelerate the needle valve element. This acceleration causes the needle valve element to reach its highest velocity during closing at the impact against the seat. Typically, the conventional needle is designed to severely limit the allowable closing velocity in the earlier phase of needle closing to prevent this high impact velocity. If the allowable closing velocity in the earlier phase of needle closing were not limited, the needle would likely bounce from its valve seat and experience excessive wear or failure over time. Moreover, a fast opening and a slow closing of the needle valve element generates a very steep on-time to fuel gain in the operating region where the needle valve element is not fully open as shown in FIG. 3*b*. This rapid increase in the fuel injection rate resulting in a very short period prior to full opening makes accurate control of the delivery of small fuel quantities, e.g. pilot injections, rate shaping, etc., very difficult. The needle valve biasing feature 20 of the present invention slows down the opening of the needle valve element thereby creating a lower on-time to fuel gain than conventional servo controlled injectors which creates a greater amount of time to accurately deliver small fuel quantities. Moreover, as shown in FIG. 3*a*, needle valve biasing feature 20 effectively causes needle valve element 16 to hover a spaced distance from drain circuit 43 when in the open position without the end face of needle valve element 16 contacting the injector body thereby preventing valve bounce and valve element sticking sometimes experienced upon contact with the injector body. Also this "hovering" effect minimizes the fuel directed to drain during opening of the valve thereby lowering parasitic losses.

Needle valve biasing feature 20 also effectively creates a fast closing of needle valve element 16 while functioning as a motion/hydraulic damper at the end of the closing event of needle valve element 16. As a result, the needle valve element of the injector of the present invention may be rapidly closed to achieve greater control over injection without violating needle valve element seat impact velocity constraints thereby minimizing needle valve element wear and eliminating failure due to excessive needle impact forces.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection rate control by a simple rate control device in order to minimize emissions. Such internal combustion engines including a fuel injector in accordance with the present invention can be widely used in all industrial fields and non-commercial applications, including trucks, passenger cars, industrial equipment, stationary power plant and others.

We claim:

1. A closed nozzle injector for injecting fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a needle valve element positioned in one end of said injector cavity adjacent said injector orifice, said needle valve element movable between an open position in which fuel may flow from said fuel transfer circuit through said injector orifice into the combustion chamber and a closed position in which fuel flow through said injector orifice is blocked, movement of said needle valve element from said closed position to said open position and from said open position to said closed position defining an injection event during which fuel may flow through said injector orifice into the combustion chamber, said needle valve element including an inner guide portion having an outer surface contacting said injector body and an outer guide portion having an outer surface contacting said injector body, said inner guide outer surface having an outer diameter greater than an outer diameter of said outer guide outer surface;

an actuating system to control the movement of said needle valve element between said open and said closed positions; and an inner control volume positioned axially along said needle valve element between said inner guide portion and said injector orifice.

2. The closed nozzle injector of claim 1, further including a spring chamber positioned axially along said needle valve element between said inner guide portion and said outer guide portion, and a bias spring positioned in said spring chamber to bias said needle valve element toward said closed position, said spring chamber positioned to receive unrestricted high pressure fuel from said fuel transfer circuit.

3. The closed nozzle injector of claim 1, further including an inner restriction orifice positioned to restrict fuel flow from said fuel transfer circuit to said inner control volume, said inner restriction orifice sized to create a pressure difference between said fuel transfer circuit and said inner control volume.

4. The closed nozzle injector of claim 3, wherein said actuating system includes an outer control volume positioned adjacent an outer end of said needle valve element, a control volume charge circuit for supplying fuel from said fuel transfer circuit to said outer control volume, a drain circuit for draining fuel from said outer control volume to a low pressure drain and an injection control valve positioned along said drain circuit for controlling the flow of fuel through said drain circuit, further including an outer restriction orifice positioned to restrict fuel flow from said fuel transfer circuit to said outer control volume.

5. The closed nozzle injector of claim 3, wherein said outer diameter of said inner guide outer surface is sized to generate a fuel pressure biasing force acting on said inner guide portion which tends to bias said needle valve element toward the closed position during an injection event.

6. The closed nozzle injector of claim 1, wherein said needle valve element is a one-piece unitary structure including said inner and said outer guide portions.

7. The closed nozzle injector of claim 1, wherein said needle valve element further includes a valve seat portion having a valve seat diameter less than said outer guide portion diameter.

8. The closed nozzle injector of claim 3, wherein said inner restriction orifice is formed in said needle valve element.

9. A closed nozzle injector for injecting fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

an actuating system to control the movement of said needle valve element between said open and said closed positions; and a needle valve biasing means for creating a fuel pressure bias closing force on said needle valve element which biases said needle valve element toward the closed position and for increasing said fuel pressure bias closing force on said needle valve element during movement from said closed position to said open position, wherein said needle valve biasing means further includes an inner control volume positioned axially along said needle valve element between said inner guide portion and said injector orifice, and an inner restriction orifice positioned to restrict fuel flow from said fuel transfer circuit to said inner control volume, said inner restriction orifice sized to create a pressure difference between said fuel transfer circuit and said inner control volume.

10. The closed nozzle injector of claim 9, wherein said needle valve biasing means further functions for creating a fuel pressure bias opening force on said needle valve element which biases said needle valve element toward said open position and for increasing said fuel pressure bias opening force as said needle valve element moves from said open position toward said closed position.

11. The closed nozzle injector of claim 9, wherein said needle valve biasing means includes an inner guide portion formed on said needle valve element and including an outer diameter, said needle valve biasing means further including an outer guide portion positioned adjacent said outer end of said needle valve element and including an outer diameter less than the outer diameter of said inner guide portion.

12. The closed nozzle injector of claim 11, further including a spring chamber positioned axially along said needle valve element between said inner guide portion and said outer guide portion, said spring chamber positioned to receive unrestricted high pressure fuel from said fuel transfer circuit.

13. The closed nozzle injector of claim 9, wherein said actuating system includes an outer control volume positioned adjacent an outer end of said needle vlave element, a control volume charge circuit for supplying fuel from said fuel transfer circuit to said outer control volume, a drain circuit for draining fuel from said outer control volume to a low pressure drain and an injection control valve positioned along said drain circuit for controlling the flow of fuel through said drain circuit, further including an outer restriction orifice positioned to restrict fuel flow from said fuel transfer circuit to said outer control volume.

14. The closed nozzle injector of claim 9, wherein said inner restriction orifice is formed in said needle valve element.

15. The closed nozzle injector of claim 11, wherein said inner guide portion is sized to generate a fuel pressure force acting on said inner guide portion which tends to bias said needle valve element toward the closed position during an injection event.

16. The closed nozzle injector of claim 11, wherein said needle valve element is a one-piece unitary structure including said inner and said outer guide portions.

17. The closed nozzle injector of claim 9, wherein said needle valve biasing means further includes a valve seat portion having a valve seat diameter less than said outer guide portion diameter.

* * * * *